United States Patent [19]

Gillette

[11] 4,330,567

[45] May 18, 1982

[54] METHOD AND APPARATUS FOR ELECTROSTATIC COATING WITH CONTROLLED PARTICLE CLOUD

[75] Inventor: Donald J. Gillette, Guilford, Conn.

[73] Assignee: Electrostatic Equipment Corp., New Haven, Conn.

[21] Appl. No.: 218,521

[22] Filed: Dec. 23, 1980

Related U.S. Application Data

[63] Continuation-in-part of Ser. No. 114,656, Jan. 23, 1980, Pat. No. 4,297,386.

[51] Int. Cl.[3] ..... B05C 3/172; B05C 19/02; B05D 1/22

[52] U.S. Cl. ..... 427/32; 118/625; 427/185

[58] Field of Search ..... 427/27, 32, 185; 118/309, 629, 630, 638, 624, 625

[56] References Cited

U.S. PATENT DOCUMENTS

| | | | |
|---|---|---|---|
| 3,336,903 | 8/1967 | Point | 427/27 |
| 3,593,678 | 7/1971 | Miller | 427/27 |
| 3,690,298 | 9/1972 | Venturi | 427/185 |
| 3,865,079 | 2/1975 | Kellams et al. | 118/629 |
| 3,919,437 | 11/1975 | Brown et al. | 427/32 |
| 3,979,531 | 9/1976 | Heller | 427/185 |
| 4,069,792 | 1/1978 | Nethersole et al. | 118/309 |
| 4,073,265 | 2/1978 | Walling et al. | 427/185 |

*Primary Examiner*—John H. Newsome

[57] ABSTRACT

An apparatus, system and method are provided for the fluidized bed electrostatic coating of workpieces, especially those of continuous length, such as metal wires. The apparatus includes a cloud control grid spanning the coating chamber, upon which may be impressed voltage and/or variable current effects, and which may be modified with depending horizontal conductors, to introduce additional cloud control capability.

39 Claims, 4 Drawing Figures

METHOD AND APPARATUS FOR ELECTROSTATIC COATING WITH CONTROLLED PARTICLE CLOUD

BACKGROUND OF THE INVENTION

This application is a continuation-in-part of applicant's copending application for U.S. patent Ser. No. 114,656, filed on Jan. 23, 1980 and entitled CONTROL GRID IN ELECTROSTATIC FLUIDIZED BED COATER, now issued as U.S. Pat. No. 4,297,386.

Electrostatic fluidized bed coating is, of course, a conventional and widely used technique for depositing particulate materials upon a great diversity of workpieces. Typical of the apparatus used for that purpose are the devices disclosed in Knudsen U.S. Pat. No. 3,916,826 and in Karr U.S. Pat. No. 4,030,446. While electrostatic coating with such devices is highly efficient, effective and safe, fluidized bed coating in general is not without its limitations and difficulties.

A particularly difficult problem relates to the attainment of uniform deposits upon all surfaces of the articles being coated. Such problems are due in part to the effects of the workpiece configuration upon the nature of the coating produced. Thus, a non-uniform workpiece will tend to develop an irregular deposit, particularly when, for example, the article has sharp edges or elements of relatively small dimension. But even when the workpiece is of entirely uniform configuration and is free of edges (e.g., when it is a length of round wire), the proximity of other workpieces will usually have an effect. Thus, when a plurality of wires are coated simultaneously, stopping or removing one of them will usually significantly change the characteristics of the deposit produced upon the others. This is highly undesirable in an automated operation, such as is, as a practical matter, necessary in the commercial production of insulated wire. But even when only one wire is involved, still a problem exists in producing the high degree of uniformity, from point to point along the full length of the wire, required for certain applications.

In those instances in which coatings are produced upon articles moving horizontally (or substantially so) above or through a fluidized bed, the difficulty of producing uniformity is compounded by the fact that rarefaction occurs upwardly within the cloud. As a result, the upper surfaces of the articles are exposed to less powder than are the lower portions, and therefore the deposits developed thereon tend to be thinner. The generally upward movement of the particles of the cloud, under the influence of the gas passing upwardly through the porous support plate of the fluidized bed, also favors the development of heavier coatings on lower surfaces.

Attempts have been made to compensate for the foregoing characteristics of electrostatic fluidized bed coating, such as through the use of appropriate masking devices to block those surfaces which would otherwise tend to receive disproportionately large amounts of the powder. Similarly, in Westervelt et al U.S. Pat. No. 4,011,832, build control means is disclosed for the purpose of selectively achieving either a uniform or a nonuniform deposit upon a workpiece, the invention being directed in particular to wire coating. While that approach has considerable merit, it nevertheless involves complexity of design, and tailoring of the equipment to a specific application.

Another difficulty which is inherent in powder coating entails the need for control, so as to minimize the waste of powder and to avoid creating an unhealthy and hazardous work environment. In some instances, these objectives are accomplished by the collection and recirculation of the coating powder, such as with a system of the sort disclosed in Carlson et al U.S. Pat. No. 4,123,175. While such systems are widely used, and are very effective, their installation does entail a considerable capital investment, and requires a significant amount of floor space. Problems of powder loss and contamination have also been dealt with through the use of electrodes, which are appropriately positioned with respect to the cloud and either grounded or charged to attract or repel fugitive particles. Such an approach is taught by Nakaya in U.S. Pat. No. 3,059,613, and by Point in U.S. Pat. No. 3,336,903. While such techniques may have merit, they do not provide the degrees of control and regulation necessary for convenient and effective operation as a practical matter, and especially not for purposes of coating wire on a commercial basis.

Many of the foregoing difficulties encountered in prior art apparatus and methods have been alleviated or avoided by Applicant's above-identified, copending parent application. However, further improvement and new and/or better approaches are of course desirable.

Accordingly, it is a primary object of the present invention to provide a novel apparatus, system and method for electrostatic powder coating, in which the spatial characteristics and/or the density and stability of the cloud of charged particles can be effectively controlled, so as to affect the nature of the deposit produced upon the workpiece.

It is also an object of the invention to provide such an apparatus, system and method whereby the thickness of the deposit can be controlled in a vertical sense, and whereby a high degree of uniformity can be achieved.

Another object of the invention is to provide such an apparatus, system and method by which close tolerances can be attained in the thickness of the coating produced from point to point along the length of the workpiece, and which are especially well suited for coating articles of continuous length, such as metal wires.

Yet another object is to provide the foregoing by means that are relatively simple, inexpensive and convenient.

SUMMARY OF THE INVENTION

It has now been found that certain of the foregoing and related objects of the invention are readily attained in an electrostatic powder coating method wherein a cloud of charged particles is produced, and a workpiece at an effectively opposite potential is exposed thereto. A cloud control grid is disposed at a level spaced above the porous plate, and has impressed thereupon a high voltage having either a negative or a positive value, with respect to ground, of 1 to 20 kilovolts. As a result, the spatial characteristics of the cloud of charged particles can be affected, so as to control the nature of the deposit produced upon a workpiece.

The cloud control grid may be subjected to plural effects, and different effects may be impressed upon discrete portions thereof. One of the effects impressed upon the cloud control grid may be produced by electrical grounding, and another by impressing upon the grid a cyclically varying current. In the latter instance, the frequency of variation may typically be from about 60 cycles to 30 megacycles per second, and an A.C. sine or square wave current, or a pulsating D.C. current, may be employed. Such a varying current may be applied to the cloud control grid regardless of whether or not a high voltage is also used (as hereinbefore mentioned), so as to increase the density and stability of the cloud and thereby improve the nature of the deposit produced upon the workpiece. Moreover, discrete portions of the grid may be subjected to different frequencies of such cyclical currents.

Ideally, in the foregoing method, ionized gas is used to fluidize and charge the particles, and most desirably the ionized gas will be passed through an electrically conductive, plenum-mounted control grid before passing through the porous plate on which the bed of particles is supported. The plenum grid is maintained at an electrical potential substantially different from, and between the potentials of, the workpiece and the gas ionizing electrode means. Not only can the distribution or spatial relationships of the particles of the cloud be altered, but the nature, uniformity and deposition rate of the powder can also be controlled, as a result. In the foregoing embodiment of the method, the plenum grid potential is generally maintained by grounding through high resistance means, and the potential of the electrode means used to ionize the gas is desirably 20 to 80 kilovolts. The resistance will normally have a value on the order of magnitude of megohms, and preferably at least 100 megohms resistance will be used.

Other objects of the invention are attained in electrostatic fluidized bed coating apparatus comprising, in combination, a housing having a generally planar, substantially horizontal porous support member mounted therein to define within the housing a fluidization chamber thereabove and a plenum therebelow. Means is provided for introducing gas into the plenum for passage upwardly through the support member, to effect fluidization of particulate coating material supplied to the fluidization chamber. Means is also provided for ionizing gas passing from the plenum into the fluidization chamber to effect electrostatic charging of the particulate material, and an electrically conductive control grid is disposed within and substantially across the plenum, effectively interposed between the support member and the ionizing means. The plenum grid is adapted for control of its electrical potential, and for substantially unimpeded passage therethrough of the ionized gas. In addition, an electrically conductive cloud control grid is disposed within and substantially across the fluidization chamber above the support member, and is similarly adapted for control of its electrical potential. The housing is adapted for the passage of a workpiece therethrough for exposure between the support member and the control grid. As a result, the cooperative effects of fluidization and electrostatic charging may produce a cloud of electrostatically charged particulate material above the support member, and the control grids may be used to affect the deposition of powder upon a workpiece exposed to such cloud.

In preferred embodiments of the apparatus, the cloud control grid is mounted for vertical adjustment within the fluidization chamber. The grid will generally be grounded, and desirably the grounding circuit will include a variable resistor. Alternatively, the cloud control grid may be connected to a voltage source for control of its electrical potential, and the voltage source may be a high voltage power supply and/or a low voltage frequency generator. The housing of the apparatus may be adapted for substantially horizontal movement therethrough of at least one workpiece of continuous length, and the gas ionizing structure will generally be maintained at a potential of 20 to 80 kilovolts.

In especially preferred embodiments of the apparatus, the housing will be adapted for passage of the continuous length workpiece longitudinally therethrough along a rectilinear path, and the cloud control grid will be of mesh-like construction, with a rectilinear elongated conductor depending therefrom. The conductor will extend parallel to, and substantially in the plane of, the rectilinear path of the workpiece. Both the grid and the conductor will be adapted for control of their electrical potential, and may therefore be used to affect the characteristics of the cloud of charged particles.

Most desirably, in such apparatus, the cloud control grid will have a pair of such conductors depending therefrom, with the conductors spaced from and parallel to one another, and lying substantially in the plane of the workpiece travel path which will be generally horizontal. The housing will generally be adapted for the passage of a plurality of continuous length workpieces substantially in the same plane, with the conductors of the cloud control grid being so spaced as to dispose them laterally outwardly of the workpieces. The cloud control grid may advantageously be substantially rectangular (in conformity with the configuration of the fluidization chamber), with the conductors depending from the opposite, laterally spaced longitudinal sides thereof. In certain embodiments, it may also be desirable to adapt the conductor to control of its electrical potential independently of the potential of other portions of the cloud control grid.

Additional objects of the invention are attained in a system for electrostatically coating a continuous length workpiece, comprising electrostatic fluidized bed coating apparatus as hereinbefore described, combined with means for continuously conveying the continuous length workpiece through the housing along the rectilinear path defined therethrough. In the preferred embodiments of the system, the conveying means will be adapted to convey a multiplicity of such continuous length workpieces simultaneously through the housing along rectilinear paths parallel to and in the plane of the first-mentioned path, with the conductors of the cloud control grid disposed to lie outwardly of all such paths.

DETAILED DESCRIPTION OF THE ILLUSTRATED EMBODIMENTS

Figure 1:
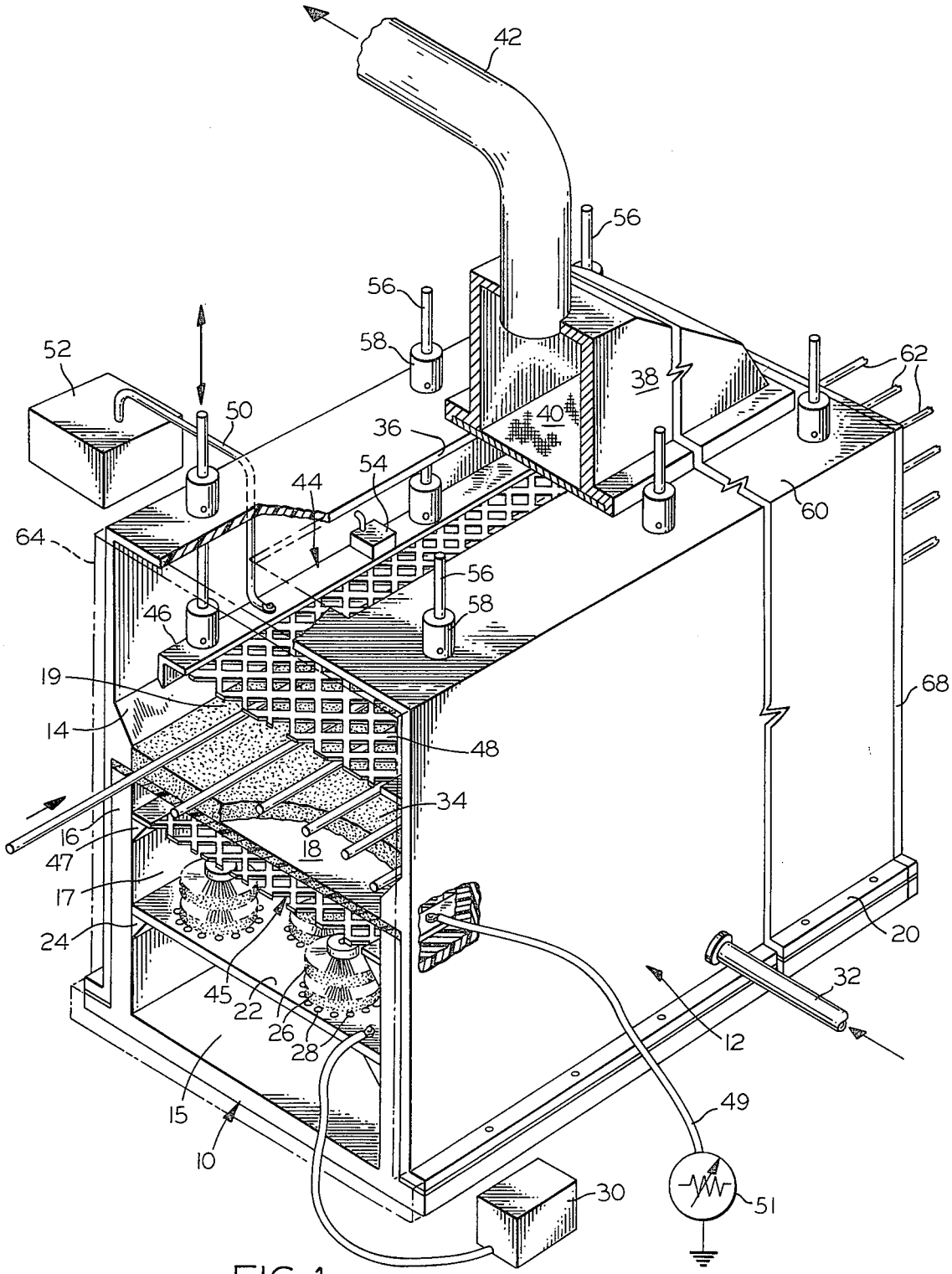
FIG. 1 is a foreshortened perspective view of an electrostatic fluidized bed coater embodying the present invention, with portions of the housing thereof being removed and broken away to expose the internal construction of the apparatus.

Turning now in detail to FIG. 1 of the drawings, therein illustrated is an electrostatic fluidized bed coater embodying the present invention and consisting of a bottom section and a top section, generally designated respectively by the numerals 10 and 12, which together provide the housing of the coater. As will be noted, the top section is telescopically mounted upon the bottom section; they together support a porous support plate 18, by clamping its margins between the peripheral flange 14 (on the inner wall of section 12) and the upper edge of the sidewall 16 of the bottom section 10. The sections are bolted together through the peripheral flange 20, provided about the lower edge of the top section 12.

A conductive metal base plate 22 spans the bottom section 10, and is supported upon a peripheral shoulder 24, which extends about the inner surface of the sidewall 16 at a location approximately midway of its height. The plate 22 has a multiplicity of wire brush electrode structures 26 (only three of which are visable) mounted at spaced locations over substantially its entire surface, and it has formed therethrough numerous holes 28, adapted and positioned for the passage of air from the lower plenum chamber 15 beneath the plate 22, into contact with the ends of the bristles of the electrode structures 26, in the upper plenum chamber 17. High voltage is applied to the plate 22 from the source 30 thereof. The electrodes 26 are charged through electrical contact with the plate 22, to thereby ionize air passing through the pipe 32, into the lower plenum chamber 15, and thereafter into contact with the electrodes 26. Such apparatus is more fully described in the above-identified Karr patent, the relevant disclosure of which is hereby incorporated by reference; further description need not, therefore, be provided.

As is also taught in the Karr patent, the ionized air passes upwardly from the plenum chamber 17, through the porous support plate 18, and into the coating chamber 19, to thereby fluidize and electrostatically charge the powder 34, which is supported upon plate 18. In the present apparatus, the top section 12 of the housing has a rectangular central opening 36, over which is secured a hood 38. The opening 38 is covered by a porous filter member 40, and a gas conduit 42 provides communication between the hood 38 and a vacuum source (not illustrated). Accordingly, the air passing upwardly through the porous support plate 18 is withdrawn from the coating chamber 19 through the filter 40 and the conduit 42.

Disposed within the coating chamber 19, which is defined within the top section 12 above the porous plate 18, is a cloud control grid assembly, generally designated by the numeral 44, which conforms to the cross sectional configuration of the top section 12 of the housing and substantially spans the coating chamber 19. The assembly 44 consists of a frame 46 constructed of angle iron elements, within which is secured an expanded metal grid 48; it is connected through cable 50 to an electrical control device 52 (which will be more fully described hereinbelow), and it has mounted thereon a vibrating device 54. Secured to the upper surface of the frame 46 are six adjustment rods 56, which pass through collars 58 affixed upon the top wall 60 of the section 12 of the housing. Set-screws are provided in the collars 58, which may be loosened to permit movement of the rods 56 therethrough, to thereby accommodate vertical adjustment of the control grid assembly 44.

Although not specifically illustrated, the construction of the grid 48 utilized in the assembly 44 is desirably such that it presents substantially no surface that is parallel to the general plane thereof, as is typical of expanded metal members (the "general plane" may be regarded to be that of the original metal sheet prior to its conversion to the expanded configuration). Accordingly, when the grid is disposed horizontally within the housing of the coater (as it will usually be in normal operation), virtually no horizontal surface will be presented thereby (by-and-large, the flat surfaces will be at a 45 degree angle to horizontal); hence, there will be very little tendency for the powder that passes through the grid 48 to collect thereupon. The vibrator 54 is provided to maintain the assembly 44 in constant agitation during operation, thereby continuously dislodging any particles of powder which may nevertheless deposit thereon (such as through electrostatic attraction), so as to further ensure that there will be no appreciable powder buildup. As will be understood, the accumulation of powder on the grid would be highly undesirable, in that clumps or agglomerates thereof, falling upon the articles during coating, would cause serious defects in the deposit. The angled elements of the grid 48 of assembly 44 is shown in FIGS. 2 and 3 of the parent application hereto; those figures, and the corresponding portions of the specification, are hereby incorporated by reference hereinto.

Disposed beneath the porous plate 18, within the upper plenum chamber 17, is a second control grid assembly, generally designated by the numeral 45. The construction of the assembly 45 is substantially the same as that of the cloud control grid assembly 44 (exclusive of the angle-iron frame construction), and so need not be described in detail. It also conforms to and substantially spans the chamber 17 in which it is disposed. However, unlike the previously described, adjustably mounted grid, the assembly 45 is fixedly mounted upon a peripheral shoulder 47 (albeit that the mounting is advantageously nonpermanent, to facilitate access and change of position, should that be desired), and hence the frame construction is modified as indicated. The grid assembly 45 is connected to ground by cable 49 through a variable high resistance 51, as will also be more fully discussed hereinafter.

Six metal wires 62 are shown passing through the coating chamber 19 at a location above the porous plate 18; although it may be used for a single wire, generally the unit will be used to simultaneously coat a multiplicity of them, and more or less than six may be involved in any particular operation. It will be appreciated that the end walls 64, 68 of the housing (the removed wall 64 being shown in FIG. 1 in phantom line) will have horizontally registered elongated slots formed therein, to permit passage of the wires therethrough.

Figure 2:
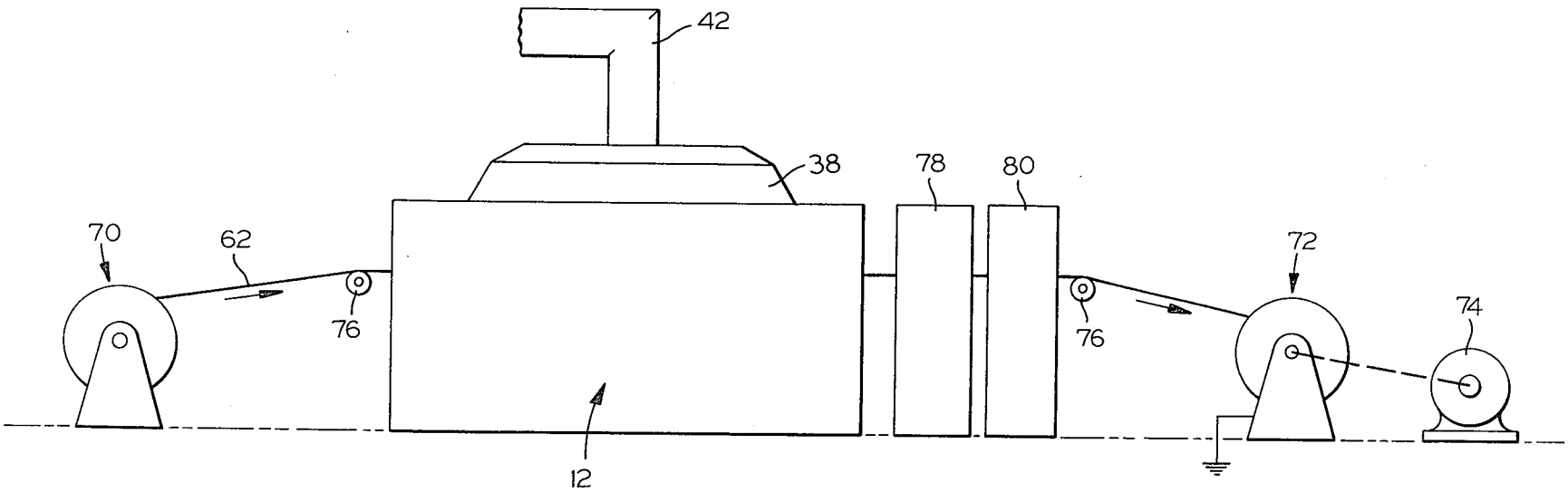
FIG. 2 is a diagrammatical elevational view of a wire coating system incorporating the coater of FIG. 1, drawn to a reduced scale.
Figure 3:
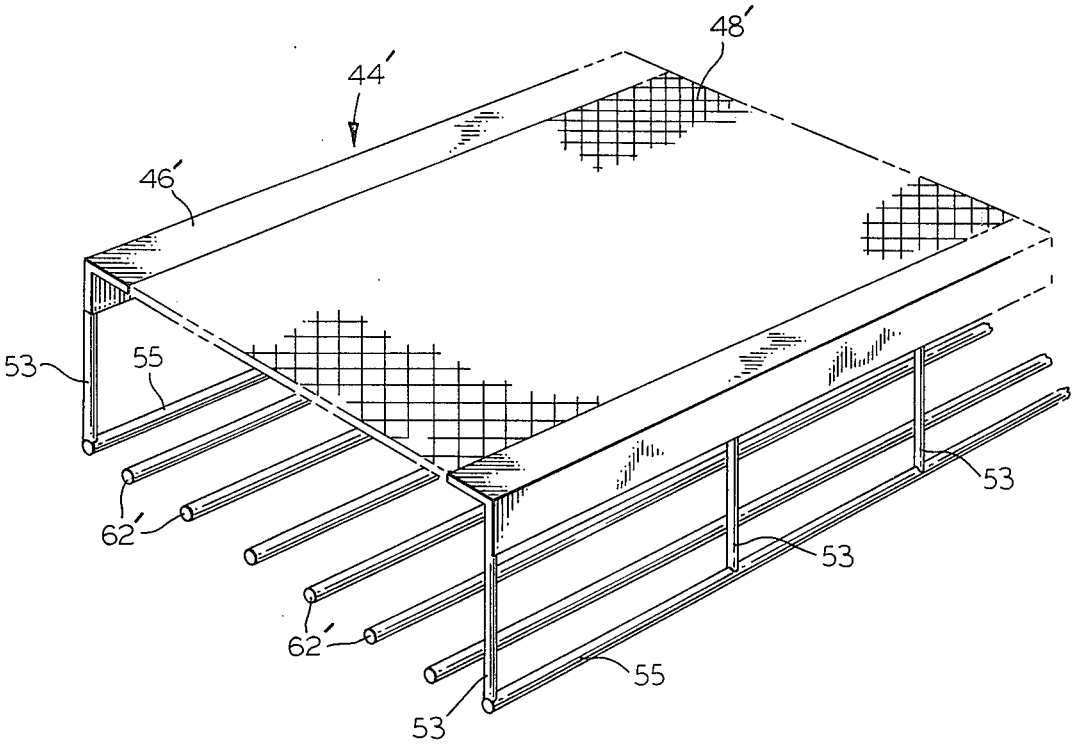
FIG. 3 is an enlarged, fragmentary perspective view of a modified form of the cloud control grid utilized in the coater.

Turning now to FIG. 2, the coating unit shown therein is that which was described in detail in connection with FIG. 1, and so need not be discussed further. Diagramatically shown therein are wire supply and takeup rolls, generally designated respectively by the numerals 70 and 72. As will be apparent, the multiple strands of wire 62 are played off from the supply roll(s) 70 and are wound upon the takeup roll(s) 72 (shown here to be grounded, to effect grounding of the wires), after passing through the fluidization chamber of the coater. Drive means 74 for the takeup roll 72, and appropriate support means for the wires, such as the idler rolls 76, are also provided, as are means 78 for heating the wire and/or the deposit (to effect fusion of the latter) and means 80 for cooling (and thus hardening) the coating subsequent to fusion. Although not illustrated, powder feed means will, of course, also be included in a typical system. As will be appreciated, FIG. 2 is intended only to be illustrative of a wire coating system of the sort for which the fluidized bed coater disclosed herein is particularly well adapted, and should not be regarded as limiting.

In operation of the system, a cloud of electrostatically charged particles will be generated above the porous plate 18, and the grounded wires 62 will attract and hold the particles during conveyance through the cloud, thus producing a deposit thereupon. Because the plenum grid assembly 47 is grounded through very high resistance, its potential will be highly negative (with respect to ground), but less negative than the base plate 22 and the electrodes 26 thereon. As a result, it is found that, although a greater amount of current (still on the order of magnitude of milliamperes) is drawn by the plate 22 and electrodes 26, the voltage required for a given rate of powder deposition upon the wires 62 is reduced significantly. For example, whereas, in the absence of the assembly 45, a potential of 70 kilovolts may be needed to produce a nominal thickness of 4 mils of powder upon a round wire moving through the coater at the rate of about 30 feet per minute, the presence of the grid 45 (grounded through a 200 megohm resistance) effects a reduction, to 50 kilovolts, of the potential on the electrodes 26 required to coat at the same rate. Under such circumstances, the grid 45 will normally have a potential of 30 to 40 kilovolts, and of the same sign (generally negative with respect to earth) as the gas ionizing structure.

It is surprisingly found that the coatings produced using the plenum grid are significantly more uniform, from point-to-point along the length of the wire, than are those produced in its absence. Thus, while the tolerance (i.e., the variation from nominal, or average, thickness) may be 25 percent or higher without the grid, its use results in a coating in which the variation may be 15 to 20 percent or less. The achievement of such improved uniformity is a primary benefit; the fact that it is accompanied by a substantial reduction in the ionization voltage demand is, of course, an added significant advantage.

While the plenum grid assembly 45 produces advantageous results by itself, concurrent use with the cloud control grid assembly 44 optimizes operation of the unit, and enables a high degree of control to be exercised in producing deposits of optimal quality and character. Hence, such concurrent use represents a preferred embodiment of the invention.

With more particular reference now to the cloud control grid assembly 44, the effects that it produces are largely dependent upon the electrical control device 52 to which it is connected. In the simplest case, the device 52 may constitute a connection to ground, albeit that a rheostat is preferably included in the grounding circuit. With such an arrangement, the grid 48 will draw the charged particles to a height above that to which they would otherwise rise, thereby densifying and regulating the cloud, and producing a high degree of uniformity therein. As a result, all surfaces of the grounded wires 62 may be exposed to substantially the same concentration of powder, and will therefore acquire a deposit which is uniform throughout.

In those instances in which the device 52 includes a rheostat, the electrical effect produced by the grid 48 upon the cloud can be altered by adjusting resistance, so as to vary the rate of charge conductance from the grid; the effect can also be altered by vertical adjustments of the assembly 44. In either instance, the strength of the field produced by the grid is changed, with the height and density of the cloud being affected commensurately. In any event, because of the potential of the grid, the particles tend to be confined below it. Air, of course, passes through the grid unimpeded, and is removed from the coater under the vacuum imposed; the filter 40 serves to remove from the air stream any particles that may be entrained therein, and thereby carried through the grid. Thus, the combined effects of the two grid assemblies 44, 45 will be a substantial enhancement of coating efficiency and uniformity, at lower applied voltages to the assembly 45.

Additional desirable results are achieved by impressing a voltage upon the cloud control grid 48 of assembly 44 (in which event the device 52 may constitute a D.C. power supply), or by grounding it; thus, the voltage may typically vary from positive to negative values (with respect to earth) of about 20 kilovolts, inclusive. In addition to producing densification and stabilization of the particle cloud, adjustment of the potential of the grid 48 may affect the spatial characteristics of the cloud, enabling it to be shifted, in effect, in a vertical sense. Thus, differentials may be produced in the thickness of the coating from top-to-bottom on the workpiece, or differentials otherwise caused may be compensated for, so as to achieve a deposit of ultimate uniformity.

Finally, and regardless of whether or not a voltage is applied, a cyclical electrical current may be impressed upon the grid assembly 44 to induce yet other changes in the nature and/or configuration of the cloud. In that event, the device 52 may include or constitute a signal generator or comparable device, by which may be applied low voltage (e.g., 50 volts) sine or square wave A.C. signals, or pulsating D.C. signals, at frequencies typically ranging from about 60 cycles to 30 kilocycles per second. The most readily observed consequence of such frequency effects appears to be enhanced levels of densification and stabilization of the cloud, although other results may also be produced thereby.

Hence, by adjusting the relative positions of the two grid assemblies 44, 45, while altering the value of the resistance 51 in the line of the plenum grid assembly 45, and the nature and value of the electrical control device 52 connected to the assembly 44, a high degree of control may be exerted upon the character and quality of the could that is developed within the coating chamber 19. This is, moreover, achieved while maintaining the improved uniformity of deposition of powder upon the workpiece that results from use of the plenum grid, as described above.

A particular benefit, which is attributable to the regulating influence that the grid 48 has upon the cloud of particles, resides in the facility with which changes in workpiece presence may be made during operation. Thus, it is found that, with the grid 48 at a suitable potential and in an appropriate position within the coating chamber, workpieces may readily be introduced, removed, or conveyed at a changed speed, with very little if any effect upon the nature and quality of the deposits produced upon other objects being coated. This is of particular importance for commercial operations, in which the avoidance of a need to shut down a system to accommodate, for example, the breakage of a wire, is of great advantage.

Figure 4:
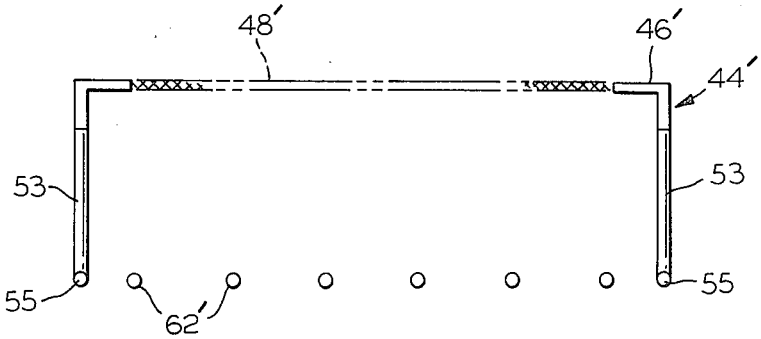
FIG. 4 is a front elevational view of the grid of FIG. 3.

The modification illustrated in FIGS. 3 and 4 of the drawings relates to the same general effect, and provides yet a further measure of control of the coating operations. More particularly, the modified grid assembly depicted therein, generally designated by the numeral 44', is of essentially the same construction as that of assembly 44 shown in FIG. 1, and includes angle iron frame members 46' and a mesh like grid 48' (diagrammatically illustrated). Depending from the longitudinally extending transverse edge at each side of the frame are a plurality of electrically conductive posts 53, and a longitudinally extending, rectilinear electrical conductor 55 is supported from the lower ends of the several posts 53 aligned along the corresponding side of the assembly 44'. As will be noted, the conductors 55 are parallel to and substantially in the horizontal plane of the several wires 62' moving through the coating unit (not shown), in which the grid assembly 44' is installed.

Since the conductors 55 will be at the same electrical potential as the remainder of the assembly 44', the cloud-regulating effect thereof will be extended to the level of the wires 62', at locations directly adjacent the outermost ones thereof. As a result, the conductors 55 function as though they were additional wires, stationarily disposed so as to regulate the effect upon the two outermost wires actually being coated. Whereas, as previously noted, the unmodified grid minimizes or moderates the effect of changes in the total workpiece mass or configuration, the degree of protection afforded to the outermost wires (which are unprotected on one side by an adjacent wire) is not entirely satisfactory in certain instances. The modified grid assembly 44' effectively corrects any deficiency in that respect.

Although not illustrated, it should be appreciated that the posts 53 (or other elements of the grid assembly 44') may be electrically insulating, with the electrical effect applied to the conductors 55 being different from that on the grid 48'. As a result, even further control of the nature and configuration of the cloud can be afforded, by means and variants that will be evident to those skilled in the art, in view of the foregoing descriptions and information.

Generally, the cloud control grid will be positioned within the coating chamber in rather close proximity to the workpiece and, in any event, below the level to which the charged particle cloud would normally ascend in the absence of the grid. Because of this, the grid should be of relatively dense and yet open construction, to enable the establishment of adequate field intensities without the creation of undesirable air currents, such as would tend to be produced if, for example, a solid plate were use; this would promote nonuniformity and thereby compromise a primary benefit of the invention. The plenum grid must be of open construction, so as to enable the ionized gas to pass substantially unimpeded therethrough. Excessive interference would be disadvantageous not only from the standpoint of fundamental pressure and flow considerations, but also because of the deionizing effect that would be engendered. The position of the grid within the plenum does not appear to be critical, as long as it is so disposed as to efficiently affect the charging gas in the desired manner, while avoiding arcing, such as to the brush electrodes 26. However, it should be appreciated that the potential of the plenum grid will be a function of its distance from the ionized gas source, as well as of the amount of resistance in the grounding circuit. Typically, the plenum grid will be spaced about 3 to 20 centimeters above the charging electrodes, in the type of unit illustrated.

As noted, both control grids should substantially span their respective chambers; however, some open areas may be present for special purposes or effects. Moreover, it may be advantageous to define isolated, independently controllable regions of the grids, so as to enable different electrical effects to be established across the bed. Also, it may be desirable, in some instances, to vertically stack two or more grids in each zone of the bed, since doing so may afford the ultimate measure of control.

Although particular emphasis has been placed upon the application of the various embodiments of the invention to the coating of articles of continuous length, it will be appreciated that the concepts hereof are not limited thereto, and may be applied with comparable advantage to the coating of numerous other discrete workpieces. Moreover, it should be understood that coating of a variety of continuous length articles is contemplated, including round and rectangular wire, metal strip, screen, and the like, with appropriate modifications being made to accommodate and most effectively coat whatever type of workpiece is involved.

Thus, it can be seen that the present invention provides a novel apparatus, system and method for electrostatic powder coating, in which the spatial characteristics and/or the density and stability of the cloud of charged particles can be effectively controlled, so as to affect the nature of the deposit produced upon the workpiece. The apparatus, system and method permit control of the thickness of the deposit in a vertical sense, thereby affording a high degree of uniformity, and close tolerances can be attained in the thickness of the coating produced, from point-to-point along the length of the workpiece. Thus, the apparatus, system and method of the invention are especally well suited for use in coating articles of continuous length, such as metal wires, and they provide all of the foregoing by means that are relatively simple, inexpensive and convenient.

Having thus described the invention, what is claimed is:

1. In a method for depositing a particulate material upon a workpiece, wherein the workpiece is exposed, at an effectively opposite potential, to a cloud of electrostatically charged particles, the improvement comprising: disposing a cloud control grid at a level spaced above the porous plate, and impressing upon the grid a voltage having either a negative or a positive value, with respect to ground, of 1 to 20 kilovolts, whereby the spatial characteristics of the cloud of charged particles can be affected so as to control the nature of the deposit produced upon the workpiece; and passing the workpiece through said cloud at a level below and out of contact with said grid.

2. The method of claim 1 wherein said gird is subjected to an additional electrical effect selected from the group consisting of grounding of said grid, impressing a cyclically varying current thereupon, or both.

3. The method of claim 2 wherein different of said effects are impressed upon discrete portions of said grid.

4. The method of claim 3 wherein one of said effects is produced by electrically grounding of one of said discrete portions.

5. The method of claim 2 wherein one of said effects is produced by impressing upon the grid a cyclically varying current.

6. The method of claim 5 wherein the frequency of variation of said current is about 60 cycles to 30 megacycles per second.

7. The method of claim 6 wherein said current is an A.C. sine or square wave current, or a pulsating D.C. current.

8. In a method for depositing a particulate material upon a workpiece, wherein the workpiece is exposed, at an effectively opposite potential, to a cloud of electrostatically charged particles, the improvement comprising: disposing a cloud control grid at a level spaced above the porous plate, and impressing upon the grid a current that varies cyclically with a frequency of about 60 cycles to 30 megacycles per second, whereby the density and stability of the cloud of charged particles can be increased to improve the nature of the deposit produced upon the workpiece.

9. The method of claim 8 wherein said current is an A.C. sine or square wave current, or a pulsating D.C. current.

10. The method of claim 8, wherein discrete portions of said grid are subjected to different frequencies of said cyclical currents.

11. In a method for depositing a particulate material upon a workpiece, wherein ionization of a gas is effected by exposing it to electrode means maintained at a high electrical potential, the ionized gas is passed through a substantially horizontal porous plate on which is supported a bed of particles to effect fluidization and electrostatic charging, so as to thereby produce a charged cloud thereof, and wherein the workpiece is maintained at a potential effectively opposite to that of said particles and is exposed thereto, the improvement comprising: passing said ionized gas through an electrically conductive, plenum-mounted control grid before passing it through said porous plate, with said grid maintained at an electrical potential substantially different from, and between the potentials of, the workpiece and the gas ionizing electrode means; disposing a cloud control grid at a level spaced above the porous plate, and impressing an electrical effect upon said cloud control grid to affect the spatial characteristics and/or the density and stability of said cloud of charged particles, so as to afford control of the nature of the deposit produced upon the workpiece, said electrical effect being selected from the group consisting of grounding of said grid, impressing thereupon a voltage having either a negative or a positive value, with respect to ground, of 1 to 20 kilovolts, impressing thereupon a cyclically varying current, and combinations thereof.

12. The method of claim 11 wherein said plenum grid potential is maintained by grounding said grid through high resistance means.

13. The method of claim 12 wherein said high resistance means has a value on the order of magnitude of megohms.

14. The method of claim 13 wherein said high electrical potential of said electrode means has a value of minus 20 to 80 kilovolts, relative to ground.

15. The method of claim 14 wherein said high resistance means has a value of at least 100 megohms.

16. The method of claim 12 wherein said electrical effect is achieved by and impressing upon the cloud control grid: (a) a potential, with respect to ground, of minus 20 kilovolts to plus 20 kilovolts, inclusive, and/or (b) a current that varies cyclically with a frequency of about 60 cycles to 30 megacycles per second, whereby the spatial characteristics and the density and stability of the cloud of charged particles can be affected, to control and improve the nature of the deposit produced upon the workpiece.

17. The method of claim 16 wherein said high electrical potential of said electrode means has a value of minus 20 to 80 kilovolts, relative to ground.

18. The method of claim 16 wherein said cloud control grid is grounded.

19. The method of claim 16 wherein said cloud control grid is charged to a negative or positive potential, with respect to ground, of 1 to 20 kilovolts.

20. The method of claim 16 wherein said cloud control grid is subjected to a plurality of said effects.

21. The method of claim 20 wherein one of said plural effects is established by grounding of said cloud control grid.

22. The method of claim 20 wherein one of said plural effects is established by charging said cloud control grid to a negative or positive potential, with respect to ground, of 1 to 20 kilovolts.

23. The method of claim 20 wherein one of said plural effects is established by impressing said varying current upon said cloud control grid.

24. Electrostatic fluidized bed coating apparatus comprising, in combination: a housing having a generally planar substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means for ionizing gas passing from said plenum into said fluidization chamber, to effect electrostatic charging of such particulate material; an electrically conductive control grid mounted within and substantially across said plenum effectively interposed between said support member and said ionizing means, said grid being adapted for control of its electrical potential and for substantially unimpeded passage therethrough of the ionized gas; and an electrically conductive cloud control grid disposed within and substantially across said chamber above said support member, said cloud control grid being adapted for control of its electrical potential, and said housing being adapted for the passage of a workpiece therethrough for exposure between said support member and said cloud control grid, whereby the cooperative effects of fluidization and electrostatic charging may produce a cloud of electrostatically charged particulate material above said support member, and whereby said grids may be used to affect the deposition of powder upon a workpiece exposed to such cloud.

25. The apparatus of claim 24 wherein said cloud control grid is mounted for vertical adjustment within said fluidization chamber, to vary its spacing from said support member.

26. The apparatus of claim 24 wherein said housing is adapted for substantially horizontal movement therethrough of at least one workpiece of continuous length.

27. The apparatus of claim 24 wherein said cloud control grid is electrically grounded.

28. The apparatus of claim 27 wherein the grounding circuit of said cloud control grid includes a variable resistor, so as to enable facile adjustment of the electrical potential of said grid.

29. The apparatus of claim 24 wherein said cloud control grid is connected to a voltage source for control of its electrical potential.

30. The apparatus of claim 29 wherein said voltage source is a high voltage power supply or a low voltage frequency generator.

31. The apparatus of claim 24 wherein said apparatus includes a resistance having a value on the order of megohms in electrical connection with said plenum-mounted grid, through which said plenum-mounted grid may be grounded.

32. Electrostatic fluidized bed coating apparatus comprising, in combination: a housing having a generally planar substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means to effect electrostatic charging of such particulate material; and an electrically conductive, cloud control grid disposed within and substantially across said chamber above said support member, said housing being adapted for the passage of a continuous length workpiece longitudinally therethrough along a rectilinear path at a location between said support member and said cloud control grid, said cloud control grid having a rectilinear elongated conductor depending therefrom and extending parallel to, and substantially in the plane of, said rectilinear path of said workpiece, both said grid and said conductor being adapted for control of their electrical potential, whereby the cooperative effects of fluidization and electrostatic charging may produce a cloud of electrostatically charged particulate material above said support member, and whereby said cloud control grid and conductor may be used to affect the characteristics of such cloud.

33. The apparatus of claim 32 wherein said control grid is mounted for vertical adjustment within said fluidization chamber, to vary its spacing from said support member.

34. The apparatus of claim 32 wherein said control grid has a pair of conductors depending therefrom, said conductors being spaced from and parallel to one another, and lying substantially in said plane.

35. The apparatus of claim 34 wherein said housing is adapted for the passage of a plurality of continuous length workpieces substantially in said plane, said conductors of said cloud control grid being so spaced as to dispose them laterally outwardly of the workpieces.

36. The apparatus of claim 34 wherein said cloud control grid is substantially rectangular, and wherein said conductors depend from the opposite, laterally spaced longitudinal sides thereof.

37. The apparatus of claim 32 wherein said conductor is adapted for control of its electrical potential independently of that of other portions of said control grid.

38. A system for electrostatically coating a continuous length workpiece, comprising:

(a) electrostatic fluidized bed coating apparatus comprising, in combination, a housing having a generally planar, substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means to effect electrostatic charging of such particulate material; and an electrically conductive, cloud control grid disposed within and substantially across said chamber above said support member, said housing being adapted for the longitudinal passage therethrough of at least one workpiece of continuous length along a rectilinear path at a location between said support member and said cloud control grid, said cloud control grid having a pair of transversely spaced, rectilinear elongated conductors depending therefrom and extending parallel to, and outwardly and substantially in the plane of, said rectilinear travel path of said workpiece, both said cloud control grid and said conductor being adapted for control of their electrical potential, whereby the cooperative effects of fluidization and electrostatic charging may produce a cloud of electrostatically charged particulate material above said support member, and whereby said cloud control grid and conductor may be used to affect the characteristics of such cloud; and (b) means for continuously conveying said workpiece through said housing of said apparatus along said rectilinear path.

39. The system of claim 38 wherein said plane is substantially horizontal, and wherein said conveying means is adapted to convey a multiplicity of such continuous length workpieces simultaneously through said housing along rectilinear paths parallel to and in the plane of said first-mentioned path, said conductors lying outwardly of all of said rectilinear paths.

* * * * *